United States Patent [19]

Johnson

[11] 4,104,446

[45] Aug. 1, 1978

[54] SELF-TAPPING OR THREAD-FORMING SCREW

[75] Inventor: Lawrence D. Johnson, Rockford, Ill.

[73] Assignee: Keystone Consolidated Industries, Inc., Peoria, Ill.

[21] Appl. No.: 723,329

[22] Filed: Sep. 14, 1976

Related U.S. Application Data

[63] Continuation of Ser. No. 588,292, Jun. 19, 1975, abandoned, which is a continuation of Ser. No. 489,413, Jun. 17, 1974, abandoned, which is a continuation of Ser. No. 196,431, Nov. 8, 1971, abandoned.

[51] Int. Cl.[2] ..... B21H 3/02; B21H 3/10

[52] U.S. Cl. ..... 428/585; 428/583; 428/584; 85/47; 85/48

[58] Field of Search ..... 428/583, 584, 585; 85/47, 48

[56] References Cited

U.S. PATENT DOCUMENTS

| | | | |
|---|---|---|---|
| 2,703,419 | 3/1955 | Barth | 85/47 |
| 3,218,905 | 11/1965 | Reiland | 85/47 |
| 3,530,760 | 9/1970 | Lindstrom | 85/48 |

*Primary Examiner*—Brooks H. Hunt

*Attorney, Agent, or Firm*—Allegretti, Newitt, Witcoff & McAndrews

[57] ABSTRACT

An improved self-tapping or thread-forming screw where the thread configuration on the screw end swages or forms the thread in an object to be threaded rather than cutting and removing a portion of the material of the object. The screw is provided with a threaded shank terminating in a tapered thread-forming end having four equi-spaced flattened surfaces separated by four threaded lobes or corners, and each corner is provided with a leading flattened surface in place of a portion of the radius to provide a partially threaded relief area in addition to the full relief areas formed by the flattened sides.

1 Claim, 6 Drawing Figures

SELF-TAPPING OR THREAD-FORMING SCREW

This is a continuation of application Ser. No. 588,292, now abandoned, filed Jun. 19, 1975, which is a continuation of Ser. No. 489,413 filed Jul. 17, 1974, now abandoned, which, in turn, is a continuation of Ser. No. 196,431 filed Nov. 8, 1971, now abandoned.

The present invention relates to a novel self-tapping or thread-forming screw and more particularly to an improved screw for the swaging of threads in the material of an object to be threaded.

In the Reiland U.S. Pat. No. 3,218,905, a self-tapping or thread-forming screw is disclosed having a novel thread-forming free end with four generally flattened relief areas separating four threaded corners, where the threads on the corners do not have sharp full crests, but have progressively shallower more concave crests as the end of the thread is approached. This screw provided an improved thread-forming operation which included a more readily insertable screw in the opening of the object to be threaded and the elimination of the high driving torques of previous screws, but retaining a high stripping torque and a better fit for the screw in the threaded object. The present invention improves on the advantages of the above noted screw by providing an improved thread-forming screw with a still lower starting torque and a better mating thread.

Among the objects of the present invention is the provision of an improved self-tapping or thread-forming screw for swaging threads in an opening formed in an object of metal, plastic or other suitable material without cutting and removing material from the object during the threading. The screw has a threaded cylindrical shank with an enlarged driving head at one end and an improved tapered thread-forming free end which is interrupted by equi-spaced relief areas. The thread is formed in the object by a progressive swaging or deforming operation that is substantially chip-free, whereby the mating thread formed in the object provides a much closer fit than that obtainable in prior thread-cutting operations.

Another object of the present invention is the provision of a novel-self-tapping or thread-forming screw provided with an improved thread-forming end. The tapered end is provided with four equi-spaced slightly concave flattened surfaces separating four equi-spaced threaded corners having partial threads thereon with a constant root diameter and progressively increasingly concave thread crests as the screw end is approached. The leading half of each corner has an angular surface replacing the corner radius, which surface extends and merges into the full threaded shank and provides an additional relief area.

A further object of the present invention is the provision of a novel self-tapping or thread-forming screw having an improved tapered thread-forming end which initially enters the opening to be threaded. The improved thread-forming end has equi-spaced threaded corners separated by relief areas, and each corner has an angular surface replacing the radius on the leading half of each corner to provide an additional relief area and reduce the torque required to form the thread by 10 to 15% over previous designs. This screw provides greater uniformity in the starting or forming torque and there is less prevailing torque once the thread has been formed resulting in an improved mating thread structure. Also, this screw provides an increased holding power in blind hole applications.

Further objects are to provide a construction of maximum simplicity, efficiency, economy and ease of assembly and operation, and such further objects, advantages and capabilities as will later more fully appear and are inherently possessed thereby.

Figure 1:
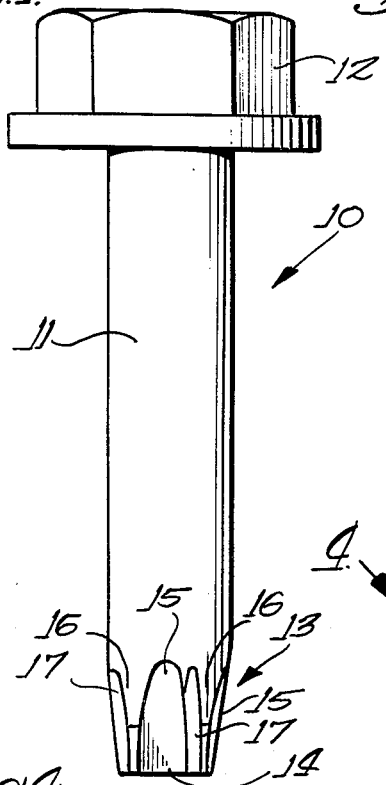
FIG. 1 is a side elevational view of the screw blank after forming of its head and tapered point but before rolling of its spiral thread.
Figure 2:
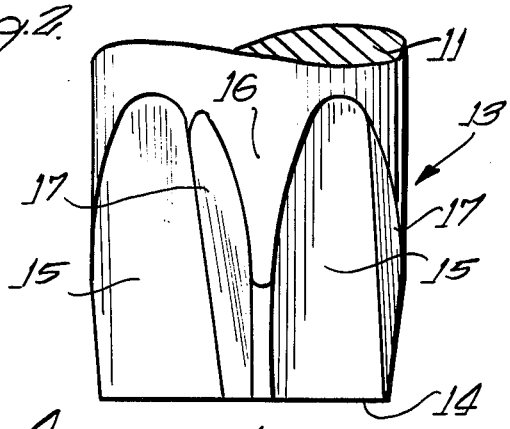
FIG. 2 is an enlarged side elevational view of the tapered point of the screw blank.

Referring more particularly to the disclosure in the drawing wherein is shown an illustrative embodiment of the present invention, FIG. 1 discloses a screw blank 10 having a cylindrical shank 11 with an enlarged driving head 12 of any suitable configuration at one end, and a tapered point 13 at the opposite end has a taper of approximately 4° from the longitudinal axis of the shank 11. Formed on the tapered point are four equi-spaced flattened surfaces 15 separating four equi-spaced rounded corners 16. Also, the leading edge of each corner has the radius replaced by a flattened angular surface 17.

Figure 3:
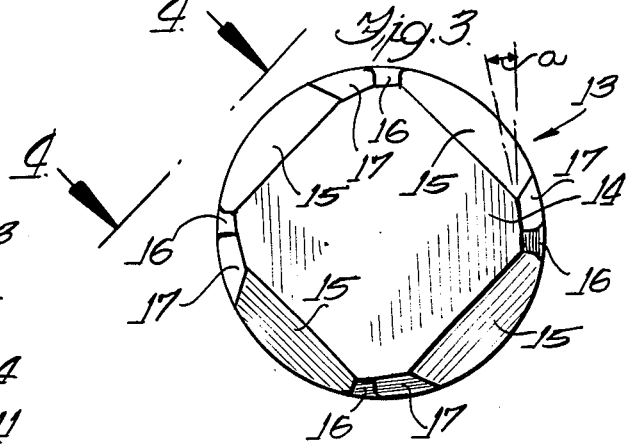
FIG. 3 is an enlarged end elevational view of the tapered point of the screw blank.
Figure 4:
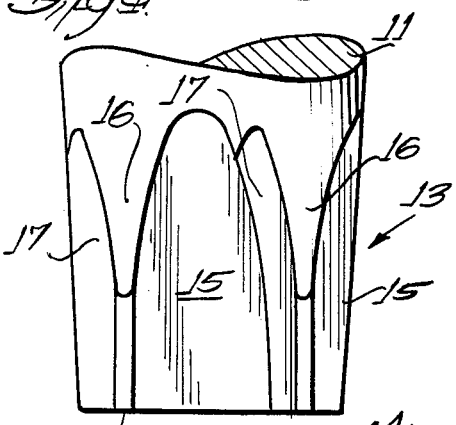
FIG. 4 is another enlarged side elevational view of the tapered point taken from the line 4—4 of FIG. 3.

The flattened sides 15 are each provided at an angle of approximately 8° to 10° relative to the longitudinal axis of the shank 11. Both the flattened surfaces 15 and the angular corner surfaces 17 extend upward along the tapered tip 13 to merge into the shank at approximately the upper edge of the tapered tip. The angle *a* (FIG. 3) is approximately 12° so that the angular surface 17 is oriented at an angle of approximately 33° to its preceding adjacent flattened surface 15', the surface 15 being in a counterclockwise direction from the angular surface 17 as seen in FIG. 3. The flattened surfaces 15 provide relief areas in the final screw while the angular surfaces 17 provide additional relief areas.

Figure 5:
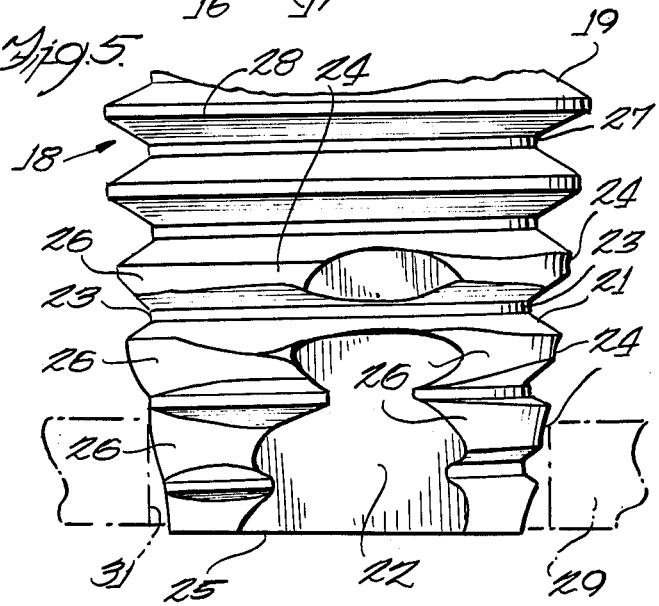
FIG. 5 is an enlarged side elevational view of the thread-forming point of the threaded screw showing the threaded corners and relief areas.
Figure 6:
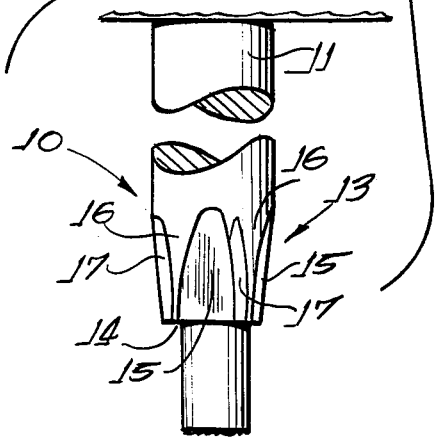
FIG. 6 is a side elevational view of the blank of FIG. 1 at an intermediate stage of the forming process prior to heading.

A screw thread 19 is rolled onto the screw shank 11 and the tapered point 13, as seen in FIG. 5, to form the finished screw 18, with the threads 21 on the point being incomplete and merging into the flattened surfaces 15; the thread rolling operation resulting in slightly concave relief areas 22 from the flattened surfaces 15 on the blank 10. The thread 21 on each corner has the same root diameter in the thread root 23 as the root 27 for the full thread 19 on the cylindrical shank, but the thread crests are not fully formed, thus providing concave crests 24 which become shallower and wider as the end 25 of the screw is approached. As the thread 21 moves from a corner 16 onto the angular surface 17, the thread crest 26 becomes more concave and of a lesser depth than that on the corner to provide a leading edge to more gradually form the thread in an object 29 (FIG. 5).

The tapered point 13 is provided with approximately 2 to 3 threads before the point merges into the cylindrical shank having a full thread 19 of a constant thread depth with a root 27 and a relatively sharp crest 28.

Both the concave relief areas 22 formed from the flattened surfaces 15 and the angular surfaces 17 provided with threads 21 having concave crests 26 extend upward from the screw end 25 on the tapered point 13 to merge into the full threaded area 19.

In applying the present novel self-tapping screws 18, the reduced end 25 is aligned with and enters the pilot opening 31 in the object 29 to be threaded. The screw enters until the interrupted thread-forming portion 21 engages the interior surface of the opening 31, and the screw is then forced against the work and turned by means of a conventional hand or power-driven tool engaging the enlarged driving head 12 of the screw. The concave crests 26 on the angular surfaces 17 initially engage the object followed by the higher concave crests 24 on the corners 16 to progressively deform the material forming the object and gradually form a thread therein.

No metal or chips are removed during the threading operation as the concave crests gradually form the root of the thread in the object while the metal being displaced by the partial interrupted threads is deformed inwardly to begin the formation of the thread crests. The slightly concave surfaces 22 separating the interrupted threads provide relief areas to allow for expansion of the deformed material. Also, the leading angular surfaces with concave thread crests 26 provide additional relief areas to more gradually and effectively deform the material.

As the screw 18 enters the opening, the progressively deeper interrupted threads 21 continue the swaging action to gradually fully form a relatively sharp crested internal thread in the opening. If the thread is formed in a metal object, the formed thread has a denser metal grain structure than can be secured by a thread-cutting operation, and a burnishing action occurs on the thread surfaces. The improved thread-forming configuration by use of the angular surfaces 17 on the corners 16 has acted to reduce the torque required to form a thread in steel by 10 to 15% over the screw disclosed in the Reiland U.S. Pat. No. 3,218,905. The improved design has also resulted in a better uniformity in the starting or forming torque and the structure of the formed mating thread has been improved because there is less prevailing torque once the thread has been formed. Also, the use of only 2 to 3 threads 21 on the tapered point 13 has increased the holding power or pullout force in blind hole applications, such as in zinc or aluminum die castings.

I claim:

1. A blank for use in the manufacture of a thread-forming screw product by the process of rolling a constant root diameter thread on said blank, said blank comprising, in combination:

an enlarged head, a cylindrical body with a longitudinal axis, and a tapered, generally conical point merging into the body at an upper edge, said conical tapered point being formed with a taper of approximately 4° from the longitudinal axis and with four equi-spaced, flat surfaces, each of said flat surfaces formed at an angle of 8°–10° from the longitudinal axis, said point further being formed with four equi-spaced additional flat surfaces, each one of said flat surfaces being in a counterclockwise direction from an associated one of said additional flat surfaces when said blank is viewed as an end elevation of the tapered point, the intersection of each flat surface and each associated additional flat surface defining a leading edge, each additional flat surface forming an angle of approximately 33° relative to the associated flat surface, said flat surfaces and said additional flat surfaces extending upward along the point and merging into the shank at approximately the upper edge of the point.

* * * * *